US006910842B1

(12) United States Patent
Yeaple

(10) Patent No.: US 6,910,842 B1
(45) Date of Patent: Jun. 28, 2005

(54) BOOKBINDING MACHINE AND METHOD FOR INDIVIDUAL BOOKBINDING SYSTEM

(75) Inventor: Ronald N. Yeaple, New Smyrna Beach, FL (US)

(73) Assignee: Yeaple Corporation, New Smyrna Beach, FL (US)

( * ) Notice: Subject to any disclaimer, the term of this patent is extended or adjusted under 35 U.S.C. 154(b) by 0 days.

(21) Appl. No.: 10/741,325

(22) Filed: Dec. 19, 2003

Related U.S. Application Data

(60) Provisional application No. 60/446,015, filed on Feb. 6, 2003.

(51) Int. Cl.[7] ..... B42C 9/00
(52) U.S. Cl. ..... 412/8; 412/6; 412/28; 412/33
(58) Field of Search ..... 412/6, 8, 28, 32–34, 412/37, 900, 902

(56) References Cited

U.S. PATENT DOCUMENTS

| | | | | |
|---|---|---|---|---|
| 2,706,645 A | * | 4/1955 | Pitner | 281/29 |
| 3,717,366 A | | 2/1973 | Decker | |
| 4,077,078 A | | 3/1978 | Snellman et al. | |
| 4,108,713 A | | 8/1978 | Weisz | |
| 4,141,100 A | | 2/1979 | Domroe et al. | |
| 4,289,330 A | | 9/1981 | Wiermanski | |
| 4,526,642 A | * | 7/1985 | Caughey | 156/311 |
| 4,855,573 A | | 8/1989 | Vercillo et al. | |
| 4,898,506 A | | 2/1990 | Lazar | |
| 5,108,244 A | * | 4/1992 | Bellanca | 412/37 |
| 5,120,176 A | | 6/1992 | Bhatia et al. | |
| 5,156,510 A | | 10/1992 | Uehara | |
| 5,256,859 A | | 10/1993 | Nanos et al. | |
| 5,275,520 A | | 1/1994 | Yano et al. | |
| 5,314,283 A | | 5/1994 | Zoltner | |
| 5,340,155 A | | 8/1994 | Podosek | |
| 5,454,680 A | | 10/1995 | Lazar | |
| 5,465,213 A | | 11/1995 | Ross | |

(Continued)

FOREIGN PATENT DOCUMENTS

| | | |
|---|---|---|
| EP | 0 334 260 | 3/1989 |
| EP | 0 334 261 | 3/1989 |
| EP | 0 481 633 | 10/1991 |
| FR | 2 546 822 | 12/1984 |

*Primary Examiner*—Monica S. Carter
(74) *Attorney, Agent, or Firm*—Allen, Dyer, Doppelt, Milbrath & Gilchrist, P.A.

(57) ABSTRACT

A bookbinding machine binds a stack of pages along a first edge thereof to form a book using an adhesive having a melting temperature and an elongated resistive strip having an adhesive atop at least a portion of a first side. The strip has two opposed ends and an electrical resistivity between the ends and is dimensioned to substantially cover the first edge of the stack, with the first side against the first edge of the stack. An electrical current is introduced to pass along the strip between the ends. The current should be sufficient to create enough heat in the strip to achieve a temperature at least as great as the melting temperature, enabling the melted adhesive to bind the stack of pages together along the first edge. Apparatus are also provided for supporting, holding, and clamping the page stack prior to and during the binding process.

29 Claims, 7 Drawing Sheets

U.S. PATENT DOCUMENTS 5,829,938 A 11/1998 Hartwig et al.
5,833,423 A 11/1998 Yamaguchi et al.
6,508,881 B1 1/2003 Muller et al.
6,652,210 B1 * 11/2003 Yeaple ..... 412/37
2002/0064437 A1 5/2002 Kuramoto et al.
2003/0063963 A1 4/2003 Kuramoto et al.

* cited by examiner

BOOKBINDING MACHINE AND METHOD FOR INDIVIDUAL BOOKBINDING SYSTEM

CROSS-REFERENCE TO RELATED APPLICATION

This application claims priority from Provisional Patent Application 60/446,015, filed on Feb. 6, 2003, entitled "Bookbinding Machine and Method for Individual Bookbinding System."

BACKGROUND OF THE INVENTION

1. Field of the Invention

The present invention relates to systems and methods for binding pages together, and, more particularly, to such systems and methods for binding individual books.

2. Description of Related Art

A variety of different techniques are known for binding books. At one end of the spectrum is the so-called perfect binding technique used for paperback books. Individual page sheets are bound directly to the inside of the spine of the cardboard cover using a hot-melt adhesive that is solid at room temperature. Perfect binding is suitable for paperback books produced in large quantities. The high-volume machines used for perfect binding are very large and costly and must be set up for each run of books, a time-consuming process that often results in making trial copies that must be discarded. High-volume perfect binding machines are not practical for running single copies of books such as those downloaded from the Internet.

Thermal tape is another means for binding books and is often employed as a finishing operation for high-volume xerographic duplicators. The pages are individual sheets, usually 8½×11 inches, and the covers are cardboard sheets of the same size as the pages. Paper tape coated on one side with hot-melt adhesive forms the spine of the book, and the adhesive is activated as it passes over heated surfaces inside the machine. There is no way to print the title and author's name on the spine unless pasted on in a separate label. While thermal tape is a convenient method for binding small lots of booklets such as college course packs, such booklets do not offer the aesthetic appeal of high-quality bound volumes.

There are various other means for binding small quantities of books using staples, plastic combs, wire spirals, and plastic posts, none of which provides the look and feel of a fine bound volume.

A preferred method for binding books is the traditional cloth binding technique used for hardcover books. The pages are printed on large sheets called signatures, which are then folded, sewed and glued together, and then trimmed. The cover consists of front and back cardboard pieces encased in decorative cloth binding material, which also forms the hinges and outer spine. Cloth binding has advantages of quality appearance, durability, and ease of page turning, since the pages are glued to a flexible inner cloth spine that is fastened to the outer spine only at its edges. Like perfect binding, cloth binding is a high-volume process involving the use of large and costly machines, and is therefore not suitable for binding single copies. There are a few craftsmen who specialize in custom binding or repairing single cloth bound books, but such work is highly skilled and expensive.

At the high end of the spectrum are leather-bound books. Produced by a process similar to cloth binding, leather-bound books offer the ultimate in luxurious appearance.

It is known in the art to heat a hot-melt adhesive onto page edges to bind a book with an external heater. It is also known to heat a hot-melt adhesive coated on an electrically resistive layer applied to the inner surface of a report binder with the use of a power supply. It is also known to use a microwave-activatable adhesive to bind books, with the adhesive placed between a sheaf of papers and the binder. Additionally, it is known to employ individual book-binding apparatus following the printing of a book from a storage medium such as a database.

Although there is widespread interest in methods for binding cut sheets from desktop computer printers into high-quality books, no commercially viable, easy-to-use device has been disclosed.

SUMMARY OF THE INVENTION

The present invention provides systems and methods for binding an individual book that has superior aesthetic qualities, can create a book with a plurality of cover types, including both hard covers and soft covers, and are easily adaptable to books of various sizes. Books made by the present systems and methods do not require trimming of the book or the binding strip upon completion of the binding process.

A method of the present invention is directed to binding a stack of pages to form a book. This method comprises the steps of placing a flyleaf inside a book cover, a spine of the flyleaf being affixed to a spine of the book cover, and placing an electrically resistive strip adjacent an inside of the flyleaf spine of a book cover. The strip has a hot-melt adhesive in contact therewith, for example, as a coating upon or impregnated into the strip.

A stack of pages desired to be bound is positioned inside the flyleaf, a binding edge of the page stack adjacent the strip, to form a book assembly. Pressure is applied to an outside of the flyleaf adjacent the strip and along the page stack binding edge, with the strip positioned between the flyleaf spine and a region of pressure application.

An electrical current is passed along the strip to create heat sufficient to melt the adhesive. The melted adhesive serves to bind together the binding edge of the page stack to the flyleaf spine and to affix a first and a last page of the page stack to the flyleaf adjacent the flyleaf spine. When the current is discontinued, the adhesive is permitted to solidify following the electrical current's being stopped and prior to removing the pressure.

The features that characterize the invention, both as to organization and method of operation, together with further objects and advantages thereof, will be better understood from the following description used in conjunction with the accompanying drawings. It is to be expressly understood that the drawings are for the purpose of illustration and description and are not intended as a definition of the limits of the invention. These and other objects attained, and advantages offered, by the present invention will become more fully apparent as the description that now follows is read in conjunction with the accompanying drawings.

DETAILED DESCRIPTION OF THE PREFERRED EMBODIMENTS

Figure 1A:
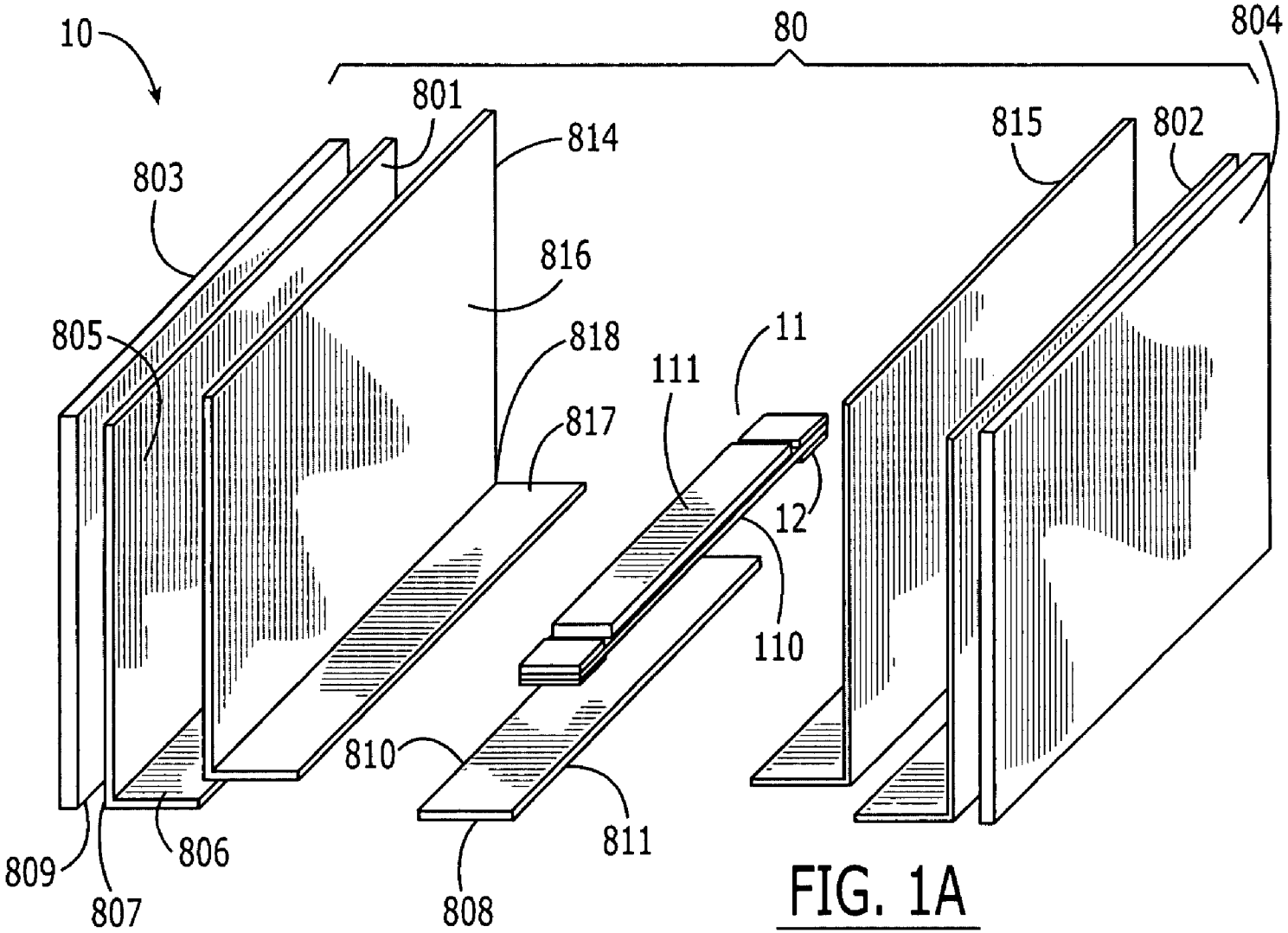
FIGS. 1A–1D illustrate a first embodiment of elements and a method for binding hardcover books with superior aesthetics.
Figure 1D:
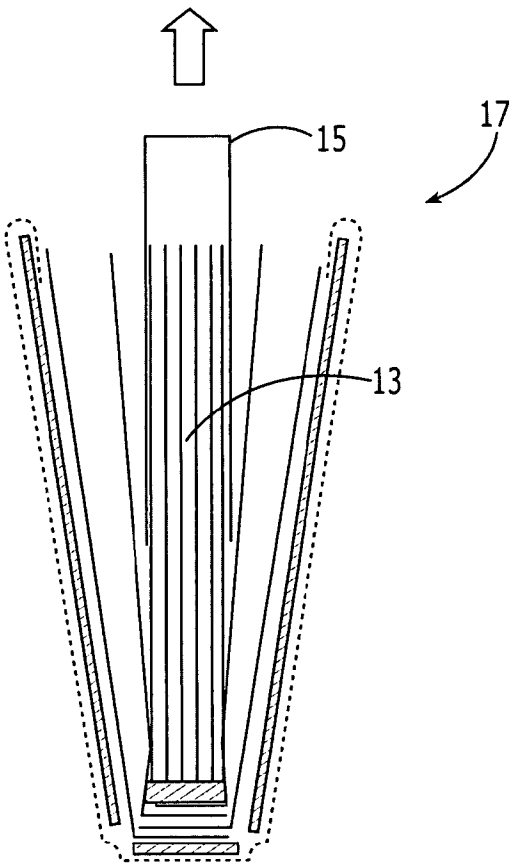
Figure 1C:
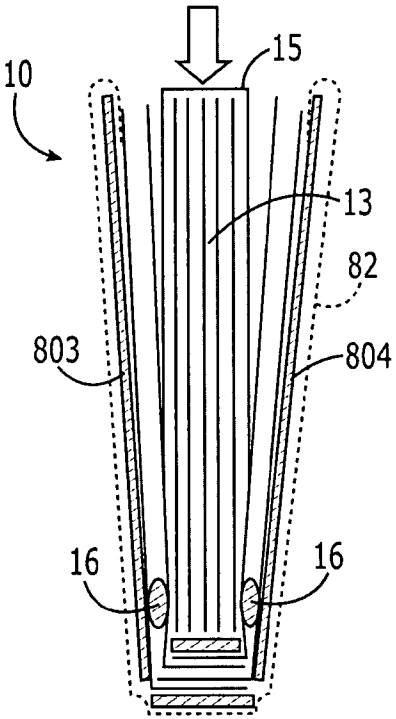

A description of the preferred embodiments of the present invention will now be presented with reference to FIGS. 1A–5.

In the present invention, the term "book" may comprise any collection of individual sheets that are desired to be bound together, and should not be taken as a limitation. Preferably all the pages should be of substantially the same size.

The invention is contemplated for use in such applications as binding a stack of pages that have been collected together or printed from a source such a desktop computer printer, as a download from a remote location (e.g., a site on the Internet), or a storage medium such as a disk. However, this application is not intended as a limitation, and one of skill in the art will understand that the invention may be used in any binding situation.

The present invention is generally directed to the binding of books wherein electric current is used to melt adhesive positioned adjacent a page stack edge desired to be bound in a hot-melt binder. The hot-melt adhesive is supplied in solid form, precoated on or impregnated into an electrically resistive strip. In use, the width of the adhesive strip is first trimmed to the approximate thickness of the page stack of the book, such as by using ordinary office shears or a paper cutter. Similarly, the length of the strip is trimmed to the approximate length of the page stack. Alternatively, various precut widths and lengths of strips may be supplied to a consumer.

In the embodiment of the system 10 and method of the invention shown in FIGS. 1A–1D, a cover assembly 80 is made by affixing a pair of liners 801,802 to an inside of front 803 and back 804 cover pieces, each liner 801,802 comprising a cover portion 803 and a spine portion 806 meeting at a fold 807. The cover pieces 803,804 comprise substantially planar, substantially rigid rectangular elements suitable for making a hardcover book. The book assembly 80 further comprises a substantially planar, substantially rigid, typically rectangular spine 808.

The cover assembly 80 is created by placing an inner edge 809 of each cover piece 803,804 adjacent respective lateral edges 810,811 of the spine 808. The liners 801,802 are positioned so that their cover portions 805 are substantially parallel, with one of the spine portions 806 atop the other spine portion. A flexible covering 82 is affixed to an outside of the front 803 and the back 804 cover pieces and the spine 808 in covering relation to at least a seam region 83 where the spine's lateral edges 810,811 meet the respective inner edges 809 of the front 803 and the back 804 cover pieces.

A pair of flyleaf elements 814,815 each comprises a cover portion 816 and a spine portion 817 meeting at a fold 818. The flyleaf elements 814,815 are positioned so that their cover portions 816 are substantially parallel, with one of the spine portions 817 atop the other spine portion.

Figure 4B:
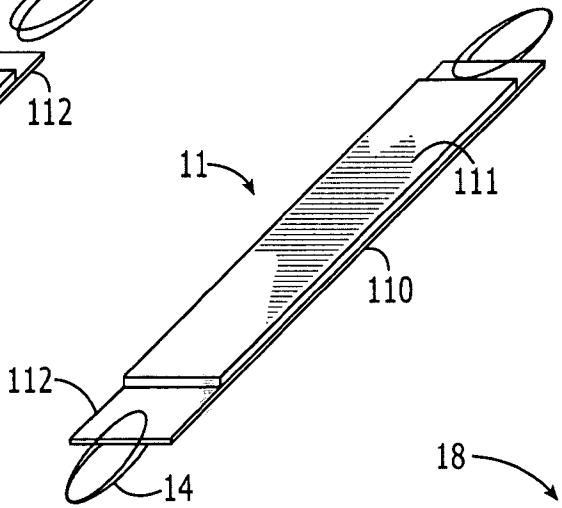
FIGS. 4A,4B is a top-side perspective view of exemplary removable clips for attaching clip leads from a power supply to the binding strip.
Figure 4A:
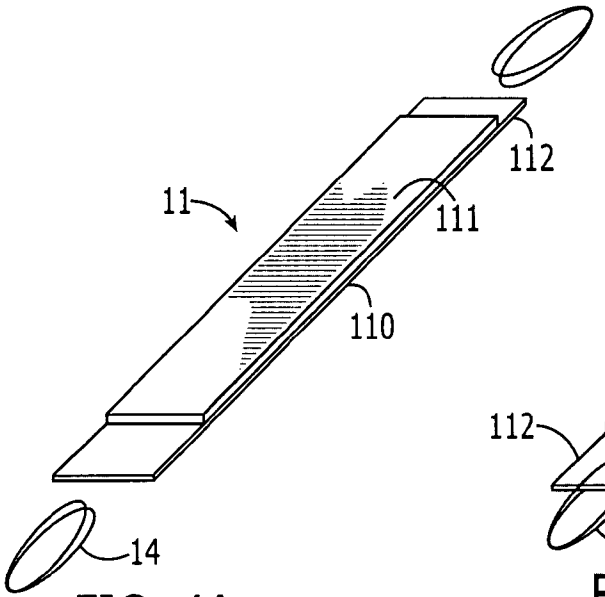

An electrically resistive strip 11, which has been coated or impregnated with a hot-melt adhesive 111, is affixed using an adhesive, such as, but not intended to be limited to, a pressure-sensitive tape 12 that has been applied to a back 110 of the strip 11, to the top flyleaf spine portion 817. The resistive strip 11 may have been trimmed to a desired dimension commensurate with the dimensions of the binding edge 131 of a page stack 13 desired to be bound. Alternatively, the resistive strip 11 may be supplied precut to match the standard lengths of various books. Clip leads 14 are removably attached to each end of the strip 11 (FIGS. 4A,4B).

Figure 1B:
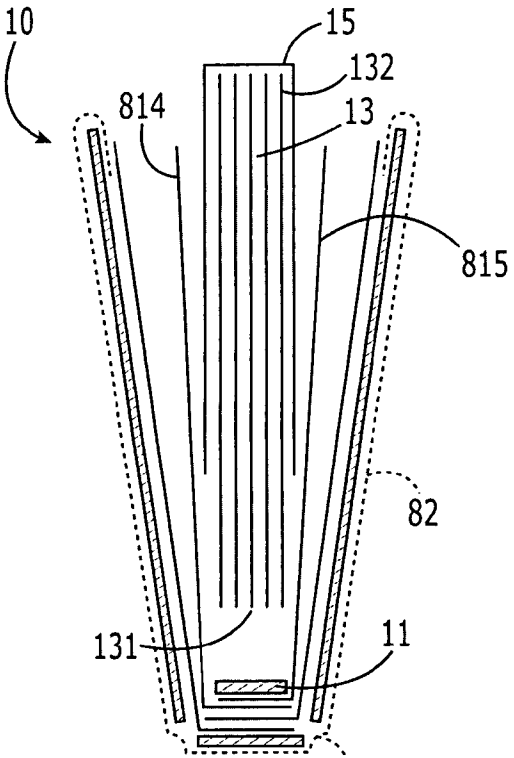
Figure 2A:
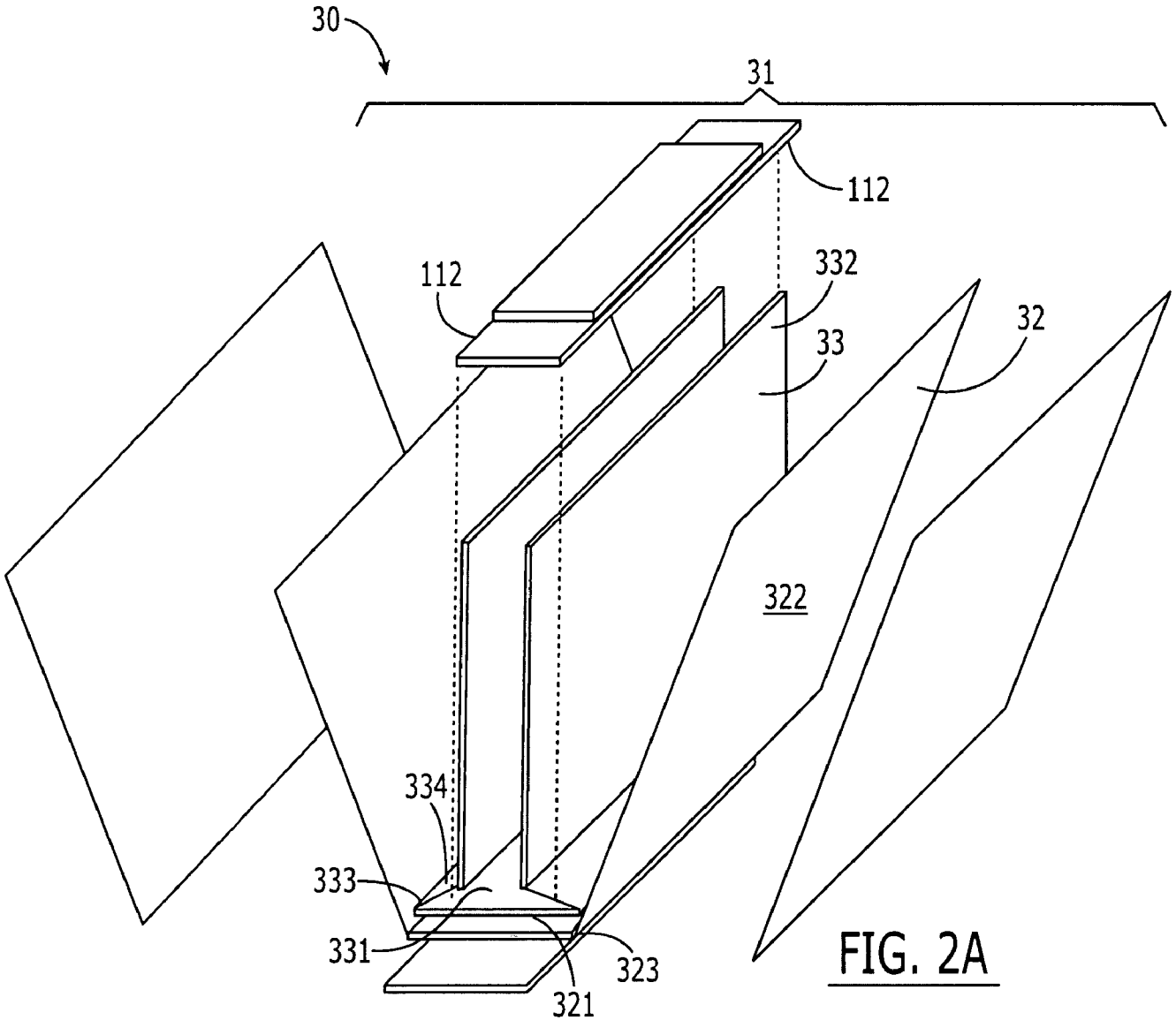
FIGS. 2A–2D illustrate a second embodiment of elements and a method for binding hardcover books with superior aesthetics.
Figure 2D:
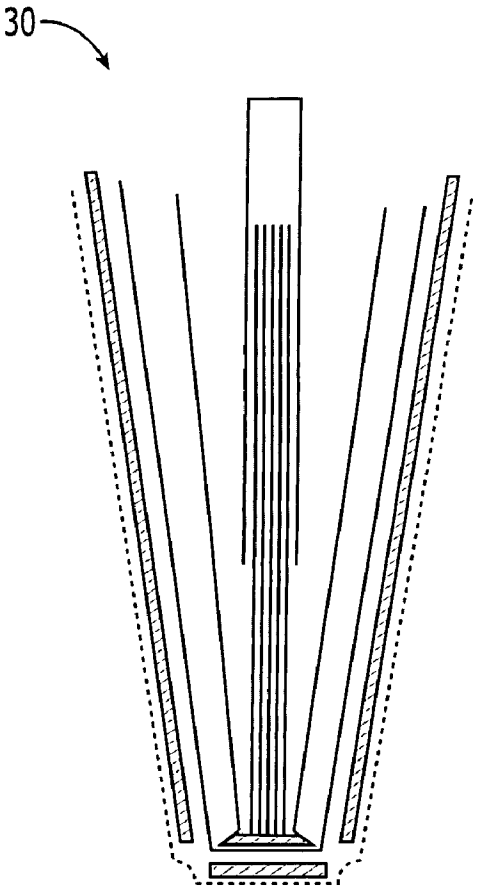
Figure 2C:
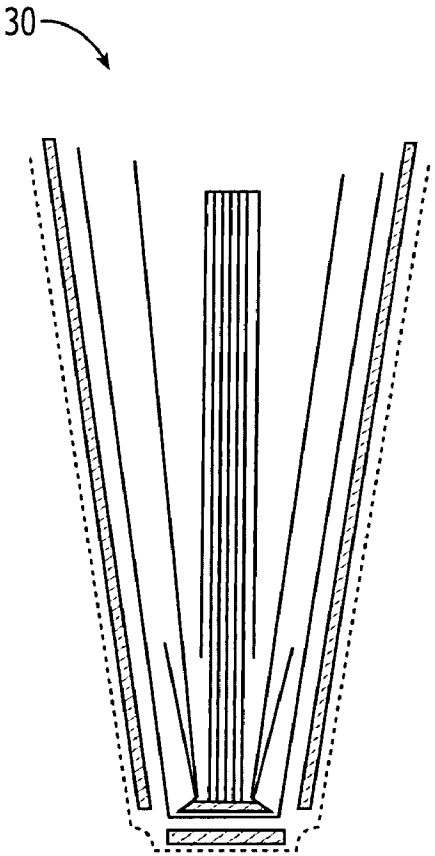
Figure 2B:
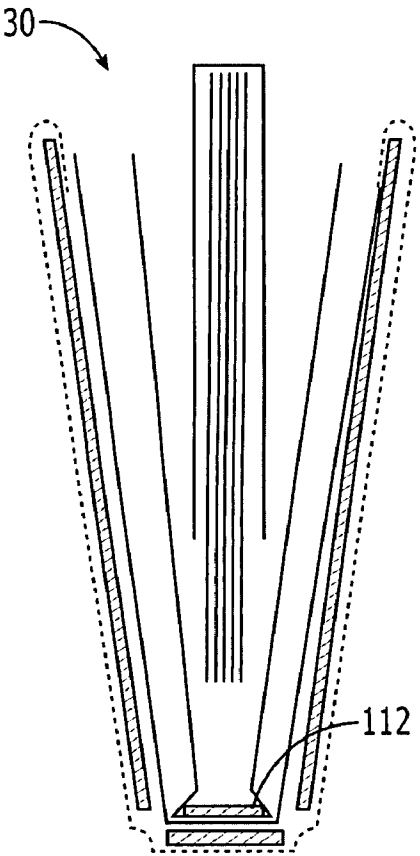

The page stack 13 is positioned between the flyleaf elements 814,815 so as to rest on the resistive strip 11, with the binding edge 131 adjacent the strip 11 (FIG. 1B). This step may be facilitated by using a page stack carrier 15 to surround at least a portion of a free edge 132 of the page stack 13. The free edge 132 is opposed to the binding edge 131. The page stack carrier 15 helps to retain an alignment of the pages during the binding process, and may comprise, as shown, a container dimensioned to receive the page stack.

In this embodiment, a pair of elongated, substantially cylindrical spacers 16 are placed between each of the flyleaf elements 814,815 and the respective book cover piece 803,804, between the strip 11 and the page stack's free edge 132, but fairly close to the strip 11.

Figure 5:
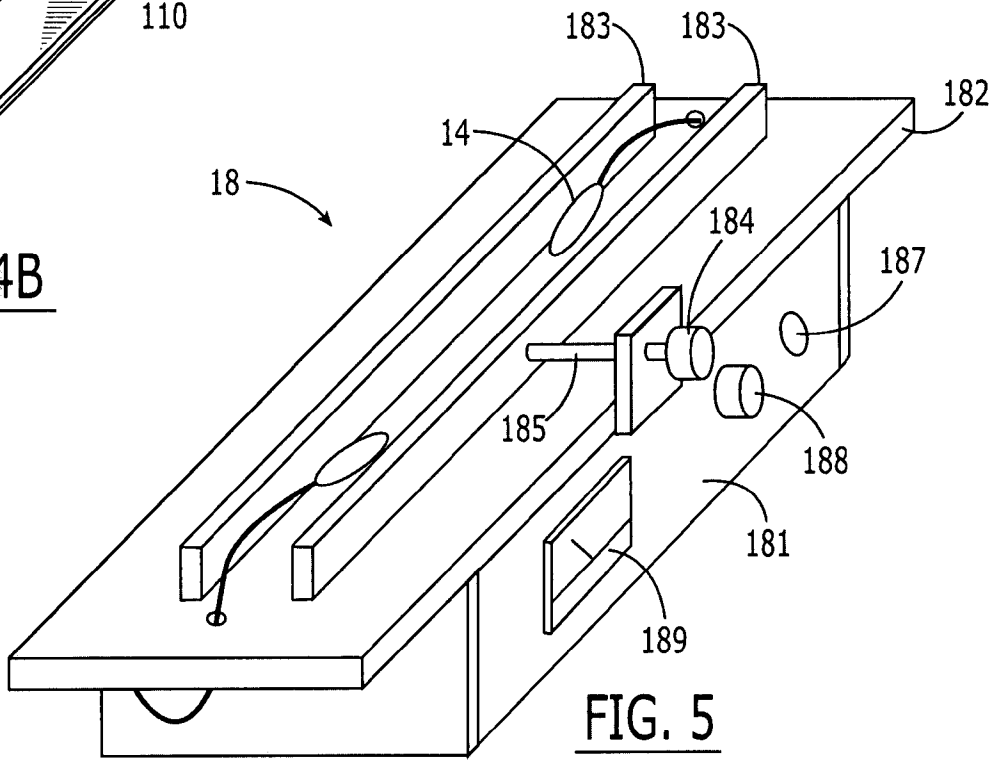
FIG. 5 is a view of an embodiment of the bookbinding machine.

The front 803 and back 804 cover pieces are folded upward along the sides of the page stack 13, and the book assembly 17 is placed into an adjustable-width substantially squared-U-shaped holder, such as, but not intended to be limited to, the bookbinding machine 18 shown in FIG. 5 to maintain the position of the parts during the binding process. This particular machine 18 will be discussed in the following.

Pressure is first applied to an outside of the flyleaf elements 814,815 adjacent the strip 11 along the page stack's binding edge 131 sufficient to hold the book assembly 17 in position. A source of electrical current in contact with the leads 14 is activated, so that the flow of current for a predetermined time heats the resistive strip 11, causing the adhesive 111 to melt. An exemplary binding voltage comprises approximately 5 volts rms to yield an exemplary binding current of approximately 5 amperes rms, and the predetermined time is typically 1–2 minutes.

During the heating cycle, the page stack 13 is pressed against the strip 11, preferably applying a scrubbing motion to the page stack 13 for increasing contact between the binding edge 131 and the melted adhesive 111. This method exposes all the pages to melted adhesive 111, and forces melted adhesive 111 between the flyleaf portions' folds 818 and onto the first and last pages of the page stack 13.

At the conclusion of the heating cycle, the current is turned off, the clip leads 14 are removed, and the page stack 13 is pressed downward toward the spine 808 to fill any spaces previously occupied by the clip leads 14. Additional clamping pressure is then applied to a pressure-application region outside the cover pieces 803,804 and adjacent the spacers 16, so that a region of the flyleaf covers 816 adjacent the flyleaf portions' folds 818 is glued to the first and last pages of the page stack 13. This technique hides an unsightly gutter between the page stack 13 and the cover 80.

The assembled book is then left in the holder 18 for several minutes while the adhesive 111 completely solidifies, typically for a period of approximately 10 minutes. The page stack carrier 15 is also removed. Following solidification, the clamping pressure is released, and the completed book is removed from the bookbinding machine 18.

In a second embodiment 30 of the invention (FIGS. 2A–3D), a cover assembly 31 is created substantially as for the first embodiment 10. Here, however, the liner 32 and the flyleaf 33 are each unitary elements. The liner comprises a single sheet folded to form a spine portion 321 and two cover portions 322 meeting at folds 323. The flyleaf 33 comprises a single sheet folded to form a spine portion 331 and two cover portions 332 meeting at folds 333, with an additional inward fold 334 that partially covers the strip's lateral edges 112. The inward folds 333,334 may be prescored.

Another feature of this embodiment 30, which could also be used with the first embodiment 10, includes a page stack alignment device (FIGS. 3A,3B) 40 for use in maintaining page alignment and also provides a feature for defining a pressure application region. The alignment device 40 comprises a pair of alignment elements 41,42. Each alignment element 41,42 has a pair of substantially rigid and substantially planar support elements 411,421, each support element having a first 412,422 and a second 413,423 cover guide extending along an outside of at least a portion of a first 414,424 and an opposed second 415,425 edge of the support element 411,421, respectively. The first 412,422 and the second 413,423 cover guides are separated by at least a height 819 of the book cover 80, at least one of the support elements 411,421 (here, the first 411) further having a first 416 and a second 417 page stack guide extending along an inside of at least a portion of the first 414 and the second 415 support element edges, respectively. The first 416 and the second 417 page stack guides are separated by at least a height 134 of the page stack 13. A flexible tape 419 may be used to connect the first 411 and the second 421 support elements together adjacent at least one of the pairs of edges 414,424;415,425 for ease of handling.

Figure 3A:
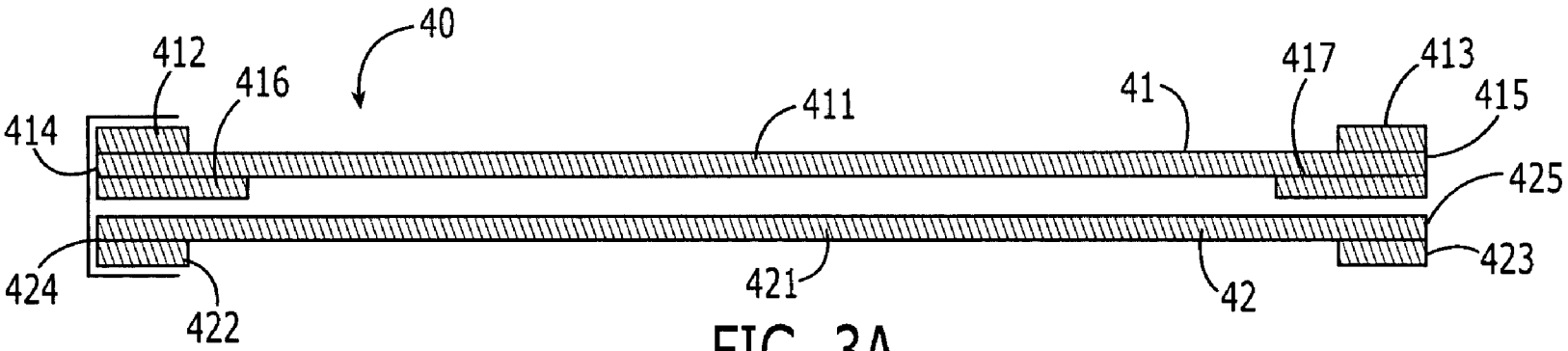
FIGS. 3A–3D illustrate elements of the page stack alignment fixture and the method of using same.
Figure 3B:
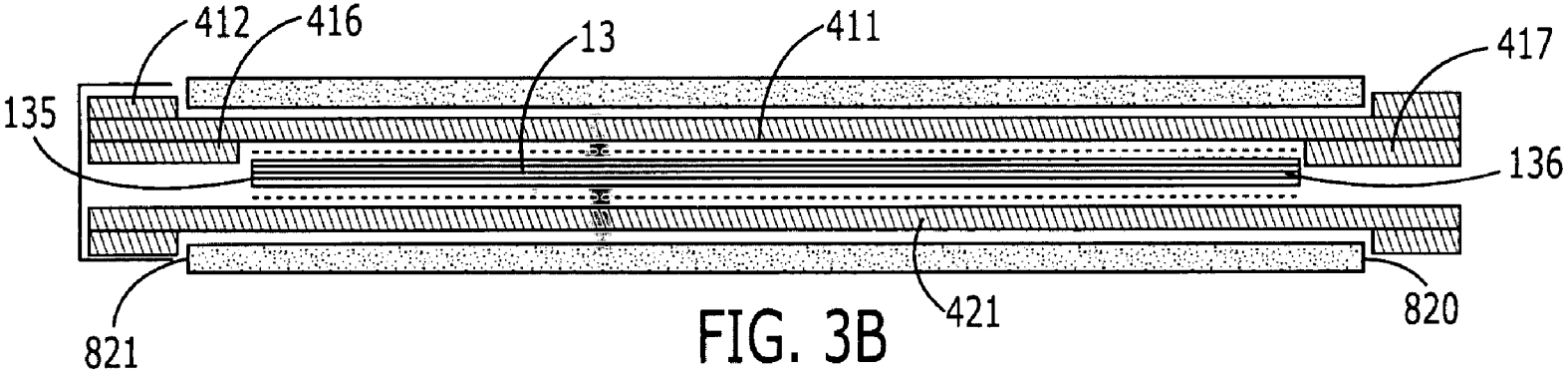
Figure 3D:
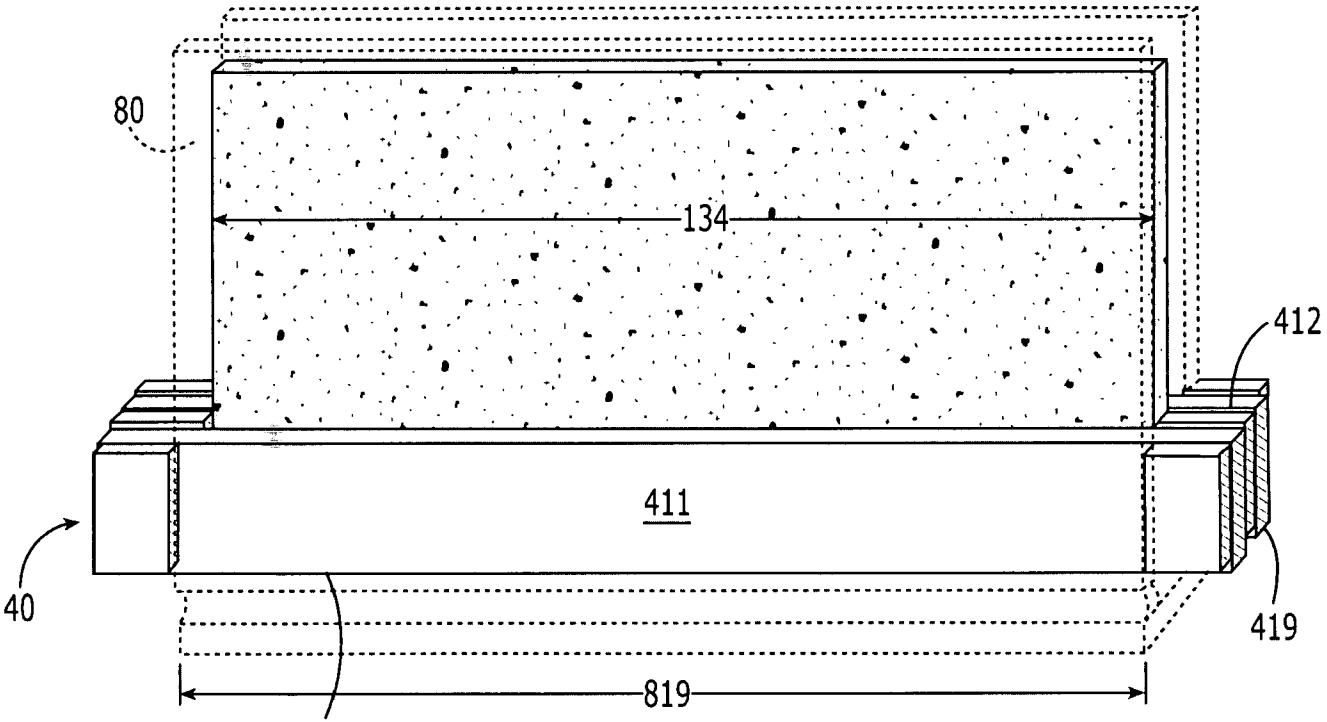
Figure 3C:
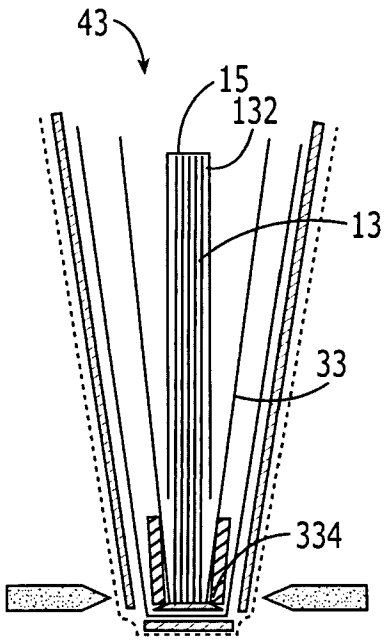

In this embodiment 30, the page stack carrier 15 is placed over the free edge 132 as above, and the alignment device 40 is positioned to straddle the page stack carrier 15 and the flyleaf cover portions 816. The page stack 13 is positioned between the support elements 411,421 as shown in FIGS. 3B–3D, the top 135 and bottom 136 edges of the page stack 13 in bounding relation to the first 416 and a second 417 page stack guides. The alignment device 40 is then slid downward so that the lower edges 418,428 of the support elements 411,421 reach the inward folds 334 of the flyleaf 33 until the top parts of the inward folds 334 cover the strip's lateral edges 112. The top and bottom edges of the cover 80 are bounded by the first 412,422 and a second 413,423 cover guides. Using the alignment device 41, the page stack 13 can be positioned within the cover 80, the page stack 13 centered along the midline of the strip 11, and midway between the top 821 and bottom 820 edges of the cover 80.

The steps of clamping the jaws of the bookbinding machine sufficiently to hold the book assembly 43 in position, applying electrical current along the strip 11 to melt the adhesive 111, turning off the current, pressing on the page stack 13 to expose the pages to melted adhesive 111, removing the clip leads 14, and pressing the page stack 13 downward are substantially as above. The alignment device 40 is used to press the flyleaf's inward folds 334 into the melted adhesive 111 (FIG. 3C). The additional clamping pressure is then applied in the region of the inward folds 334. The cooling, solidifying, unclamping, and book-removal steps are substantially as above.

This system and method offer several advantages:

Pre-scored sections of the flyleaf 33 adjacent the strip 11 can be folded down and glued in place at the time of binding to cover the unsightly gap in the gutter between the page stack 13 and the inner surface of the cover 80.

By prescoring a series of parallel folds in the flyleaves, a single cover size and resistive strip 11 can accommodate a wide range of page stack thicknesses (e.g., from ⅛th to ½ inch). This would be desirable for creating digital photo albums, for example, which might contain from 10 to 50 pages. (Each page of inkjet photo paper is about 10 mils thick.) The thickness of the cover portions 803,804 can be chosen to provide the most pleasing aesthetics for the book, with covers neither excessively pinched in nor bulging out relative to the spine width over the expected range of page stack thicknesses.

Maintaining a minimum cover spine width of at least ½ inch is desirable to accommodate lettering on the spine, for example a book title in hot-stamped gold letters. This construction permits the spine width to be maintained at ½ inch even with thin page stacks (e.g., ⅛th inch).

The hinges of the cover are mechanically isolated from the binding of the page stack, so that the cover opens easily without creating stress in the page stack binding that might cause the binding to split.

A page stack alignment fixture 40 fabricated from hardboard, plastic, wood, or similar material (FIG. 3A) is designed with guides to center the page stack along the midline of the resistive strip 11 and midway between the top and bottom edges of the cover. It also provides a means to press the folded bottoms of the flyleaves against the melted adhesive at the conclusion of the heating cycle to cover the unsightly gutter.

A method for binding a paperback book is similar, although some steps preferred for binding hardcover books are omitted: Using the small pads of pressure-sensitive tape 12 that are supplied on the back of the binding strip 11, tack the binding strip 11 to the inside spine 806 of the empty book cover 80 (FIG. 1B). Attach removable clips 14 to the ends of the resistive strip 11 (FIG. 4B). Place the empty cover 80 between the jaws of the bookbinding machine 18 and attach the clip leads 14 to the strip 11. Insert the page stack 13 into a page stack carrier 15 (see FIG. 1B) and place it in position within the cover 80. Clamp the jaws of the bookbinding machine 18 just enough to hold the cover 80 and page stack 13 in position. Switch on the power and adjust the current control. After 1–2 minutes of heating, press down on the page stack carrier 15 with a scrubbing motion to expose all the pages to the melted adhesive 111. Switch the power off, immediately pull out the clip leads 14, and press down firmly on the page stack carrier 15 to fill any spaces previously occupied by the clip leads. Check alignment of all parts and clamp firmly; allow the bound book to cool for 10 minutes so that the adhesive 111 can completely solidify.

An exemplary embodiment of the bookbinding machine 18 of the present invention is illustrated in FIG. 5. A low-voltage power supply 181 is surmounted by a rigid binding platform 182. To avoid short circuits if accidentally touched by the clip leads 14 during the binding cycle, the platform 182 is made of a nonconducting material such as wood or plastic, the jaws 183 that clamp the book during the binding cycle have insulating coatings, and the clip leads 14 are insulated except for the tips. The binding platform 182 extends beyond the lateral extent of the power supply 181, facilitating carrying the device 18.

In an exemplary embodiment, the stationary and adjustable jaws 183 are 14 in. long, so that it is possible to bind books from pocketsize to coffee table-size, having spine lengths ranging from 2 to 14 in. The space between the jaws 183 can be adjusted by means of a knob 184 and lead screw 185 to accommodate books up to 2 in. thick.

The insulated clip leads 14 provide flexibility to connect the power supply 181 to the resistive binding strip 11 of books of any size in the range of spine lengths and thickness specified above.

The front-mounted control panel contains a power switch 187 that is illuminated when the power is on, a knob 188 for adjusting the binding current, and a meter 189 for measuring the binding current to set the optimal binding current for books of various sizes. Experiments have shown that it is important to control the binding current. If the current is too low, the melted adhesive will not achieve and hold the low viscosity (typically less than 5000 centipoise) necessary to soak up into the edges of the page stack 13 to ensure optimal binding strength. If the current is too high, the spine 801 of the cover 80 may be scorched. Since the power dissipated in the binding strip 11 is proportional to the square of the current, accurate control of the current is very important.

The solid-state power supply 181 provides a low-voltage pulse-width-modulated ac binding voltage to minimize contact resistance losses that would be excessive if, for example, variable-voltage dc were to be used. For safety, the binding voltage is typically about 5 volts rms and the binding current is typically about 5 amperes rms. The design of the power supply circuitry is straightforward for someone skilled in the art of electronic power supplies. If desired, a binding cycle timer (not shown) to switch off the power at the end of the binding cycle could be added.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

What is claimed is:

1. A method of binding a stack of pages to form a book comprising the steps of:

placing a flyleaf inside a book cover, a spine of the flyleaf affixed to a spine of the book cover;

placing an electrically resistive strip adjacent an inside of the flyleaf spine of a book cover, the strip having a hot-melt adhesive in contact therewith;

positioning a stack of pages desired to be bound inside the flyleaf, a binding edge of the page stack adjacent the strip, to form a book assembly;

passing an electrical current along the strip to create heat sufficient to melt the adhesive, melted adhesive serving to bind together the binding edge of the page stack and to affix a first and a last page of the page stack to the flyleaf adjacent the flyleaf spine;

applying pressure to an outside of the flyleaf adjacent the strip and along the page stack binding edge, the strip positioned between the flyleaf spine and a region of pressure application;

stopping the electrical current; and permitting the adhesive to solidify.

2. The method recited in claim 1, wherein the pressure-applying step causes a section of the flyleaf adjacent the pressure-application region to at least partially fold over lateral edges of the strip.

3. The method recited in claim 1, wherein the positioning step comprises surrounding at least a portion of a free edge of the page stack with a page stack carrier, the free edge opposed to the binding edge, for retaining an alignment of the pages during the pressure-applying and current-passing steps.

4. The method recited in claim 1, wherein the page-stack-positioning and the pressure-applying steps comprise placing the page stack in a substantially squared-U-shaped holder having sides comprising jaws and an adjustable width between the jaws, and clamping the jaws about the book assembly along a spine region thereof.

5. The method recited in claim 4, further comprising the step, prior to the adhesive solidification, of pressing the page stack against the strip while the adhesive is melted.

6. The method recited in claim 1, wherein the adhesive solidification step comprises retaining the book assembly in the holder until the adhesive is substantially completely solidified.

7. The method recited in claim 1, wherein the electrical current passing step comprises attaching a lead to each end of the strip, connecting the leads to a power supply, and activating the power supply.

8. The method recited in claim 7, further comprising the step, prior to the adhesive solidification, of pressing the page stack against the strip while the adhesive is melted.

9. The method recited in claim 8, wherein the page stack pressing step comprises applying a scrubbing motion to the page stack for increasing contact between the page stack binding edge and the melted adhesive.

10. The method recited in claim 7, wherein the power supply activating step comprises applying a binding voltage of approximately 5 volts rms to yield a binding current of approximately 5 amperes rms.

11. The method recited in claim 1, wherein the strip-placing step comprises applying an adhesive material to a back of the strip and adhering the strip back to the flyleaf spine therewith.

12. The method recited in claim 11, wherein the adhesive material comprises a pressure-sensitive tape.

13. The method recited in claim 1, further comprising the step of making the book cover, comprising the steps of affixing together a front cover piece, a back cover piece, and a spine, a lateral edge of the spine adjacent a respective inner edge of the front and the back cover pieces.

14. The method recited in claim 13, wherein the affixing step comprises affixing a flexible covering to an outside of the front and the back cover pieces and the spine in covering relation to at least a seam region where the lateral edges of the spine meet the respective inner edges of the front and the back cover pieces.

15. The method recited in claim 14, further comprising the step, prior to the flyleaf-placing step, of affixing a liner to an inside of the front and the back cover pieces and the spine in covering relation to at least a seam region where the lateral edges of the spine meet the respective inner edges of the front and the back cover pieces.

16. The method recited in claim 1, further comprising the step, prior to the strip-placing step, of trimming the strip to a desired dimension commensurate with a dimension of the page stack binding edge.

17. The method recited in claim 1, wherein the pressure-applying step comprises:

temporarily positioning a pair of elongated spacers between the book cover and the flyleaf outside, the spacers between each cover portions of the flyleaf and a front and a rear of the cover piece, the strip between the flyleaf spine and the spacers; and after the electrical current passing step, applying a clamping pressure to opposed sides of an outside of the cover adjacent the spacers.

18. The method recited in claim 1, wherein:

the positioning step comprises placing the page stack between a pair of alignment elements, each alignment element having a pair of substantially rigid and substantially planar support elements, each support element having a first and a second cover guide extending along an outside of at least a portion of a first and a second edge of the support element, respectively, the first edge opposed to the second edge, the first and the second cover guides separated by at least a height of the book cover, at least one of the support elements further having a first and a second page stack guide extending along an inside of at least a portion of the first and the second support element edges, respectively, the first and the second page stack guides separated by at least a height of the page stack; and the pressure-applying step comprises applying a clamping pressure after the electrical current passing step to opposed sides of an outside of the cover along the support elements.

19. A system for binding a stack of pages to form a book comprising:

an electrically resistive strip positionable adjacent an inside of a spine of a flyleaf of a book cover, the strip having a hot-melt adhesive in contact therewith, the flyleaf inside a book cover, a spine of the flyleaf affixed to a spine of the book cover;

means for applying clamping pressure to a book assembly comprising a stack of pages inside the flyleaf, a binding edge of the page stack adjacent the strip, the pressure applyable to an outside of the flyleaf adjacent the strip and along a binding edge of the page stack, the strip positioned between the flyleaf spine and a region of pressure application;

a source of electrical current positioned to pass electrical current along the strip to create heat sufficient to melt the adhesive, melted adhesive serving to bind together the binding edge of the page stack and to affix a first and a last page of the page stack to the flyleaf adjacent the flyleaf spine; and a pair of spacing elements positionable between the book cover and the flyleaf outside, the spacing element along an outside of and adjacent the strip, the pressure application region located along opposed sides of an outside of the cover adjacent the spacers.

20. The system recited in claim 19, further comprising a page stack carrier adapted to surround at least a portion of a free edge of the page stack, the free edge opposed to the binding edge, for retaining an alignment of the pages during the pressure application and current passing.

21. The system recited in claim 19, further comprising a substantially squared-U-shaped holder having sides comprising jaws and an adjustable width between the jaws, the jaws dimensioned to clamp the book assembly along the pressure application region.

22. The system recited in claim 19, wherein the electrical current source comprises a power supply attachable to a pair of leads, the leads connectable to respective ends of the strip.

23. The system recited in claim 22, wherein the power supply is adapted to deliver a binding voltage of approximately 5 volts rms to yield a binding current of approximately 5 amperes rms.

24. The system recited in claim 19, wherein the spacing elements comprise a pair of elongated, substantially tubular rods.

25. The system recited in claim 19, further comprising a pair of alignment elements, each alignment element having a pair of substantially rigid and substantially planar support elements, each support element having a first and a second cover guide extending along an outside of at least a portion of a first and a second edge of the support element, respectively, the first edge opposed to the second edge, the first and the second cover guides separated by at least a height of the book cover, at least one of the support elements further having a first and a second page stack guide extending along an inside of at least a portion of the first and the second support element edges, respectively, the first and the second page stack guides separated by at least a height of the page stack, the spacing elements comprising the support elements; and wherein the pressure application region comprises opposed sides of an outside of the cover adjacent the cover spine and the first side of the support elements.

26. A method of increasing usage of a printer and printing supplies comprising the steps of:

assembling a means for binding a stack of printed pages to form a book, the binding means comprising:

an electrically resistive strip positionable adjacent an inside of a spine of a flyleaf of a book cover, the strip having a hot-melt adhesive in contact therewith, the flyleaf inside a book cover, a spine of the flyleaf affixed to a spine of the book cover;

means for applying clamping pressure to a book assembly comprising a stack of pages inside the flyleaf, a binding edge of the page stack adjacent the strip, the pressure applyable to an outside of the flyleaf adjacent the strip and along a binding edge of the page stack, the strip positioned between the flyleaf spine and a region of pressure application;

a source of electrical current positioned to pass electrical current along the strip to create heat sufficient to melt the adhesive, melted adhesive serving to bind together the binding edge of the page stack and to affix a first and a last page of the page stack to the flyleaf adjacent the flyleaf spine;

a pair of spacing elements positionable between the book cover and the flyleaf outside, the spacing elements along an outside of and adjacent the strip, the pressure application region located along opposed sides of an outside of the cover adjacent the spacers; and offering the binding means for sale.

27. The method recited in claim 26, wherein the binding means further comprises a page stack carrier adapted to surround at least a portion of a free edge of the page stack, the free edge opposed to the binding edge, for retaining an alignment of the pages during the pressure application and current passing.

28. The method recited in claim 27, wherein the spacing elements comprise a pair of elongated, substantially tubular rods.

29. The system recited in claim 27, wherein the binding means further comprises a pair of alignment elements, each alignment element having a pair of substantially rigid and substantially planar support elements, each support element having a first and a second cover guide extending along an outside of at least a portion of a first and a second edge of the support element, respectively, the first edge opposed to the second edge, the first and the second cover guides separated by at least a height of the book cover, at least one of the support elements further having a first and a second page stack guide extending along an inside of at least a portion of the first and the second support element edges, respectively, the first and the second page stack guides separated by at least a height of the page stack, the spacing elements comprising the support elements.

* * * * *